US005404081A

United States Patent [19]

Kane et al.

[11] Patent Number: 5,404,081

[45] Date of Patent: * Apr. 4, 1995

[54] FIELD EMISSION DEVICE WITH SWITCH AND CURRENT SOURCE IN THE EMITTER CIRCUIT

[75] Inventors: Robert C. Kane, Scottsdale; Robert T. Smith, Mesa, both of Ariz.

[73] Assignee: Motorola, Inc., Schaumburg, Ill.

[ * ] Notice: The portion of the term of this patent subsequent to May 17, 2011 has been disclaimed.

[21] Appl. No.: 7,685

[22] Filed: Jan. 22, 1993

[51] Int. Cl.[6] ..... G09G 3/10

[52] U.S. Cl. ..... 315/169.1; 315/169.3; 315/167; 315/349

[58] Field of Search ..... 315/8.61, 169.3, 167, 315/158, 349, 169.1; 313/309, 336, 307; 257/10, 52

[56] References Cited

U.S. PATENT DOCUMENTS 4,516,146 5/1985 Shannon et al. ..... 357/52
4,810,934 3/1989 Shimoda et al. ..... 315/107
5,153,483 10/1992 Kishino et al. ..... 315/169.1 X
5,155,420 10/1992 Smith ..... 315/349
5,157,309 10/1992 Parker et al. ..... 315/169.1
5,210,472 5/1993 Casper et al. ..... 315/169.1 X
5,212,426 5/1993 Kane ..... 315/169.1
5,313,140 5/1994 Smith et al. ..... 315/169.1

*Primary Examiner*—Benny Lee
*Assistant Examiner*—Haissa Philogene
*Attorney, Agent, or Firm*—Eugene A. Parsons

[57] ABSTRACT

An integrally formed field emission device and electron emission control circuit wherein electron emission is controlled by a current source semiconductor circuit and a semiconductor switch coupled such that upon application of switching information to the switch the field emission device is enabled to an ON mode for the time duration of the information and during which time the current source provides a determined electron current to be subsequently emitted by the emitter of the field emission device. A field emission device array and electron emission control circuits is provided to effectively control electron emission for each field emission device in the array.

15 Claims, 5 Drawing Sheets

FIELD EMISSION DEVICE WITH SWITCH AND CURRENT SOURCE IN THE EMITTER CIRCUIT

FIELD OF THE INVENTION

This invention relates generally to field emission devices and more particularly to integrally electronically controlled field emission devices.

BACKGROUND OF THE INVENTION

Field emission devices are known and commonly comprised of electron emitters which emit electrons into a free-space (vacuum) region by means of an induced electric field near the surface of the electron emitter. The electric field in many instances is realized by providing an extraction electrode (gate electrode) in close proximity to the electron emitter and applying a suitable potential therebetween. Emitted electrons are commonly, although not necessarily, collected by a distally disposed anode. However, in many instances field emission devices are identified as electron emitters with associated extraction electrode only. In many applications it is desirable to effect a means to control the field emission device electron emission.

It is known that by providing a select voltage between the extraction electrode of a field emission device and the electron emitter that the electron emission from the electron emitter will be prescribed in accordance with the electric field induced at the emitting surface of the electron emitter in accordance with the Fowler-Nordheim relation which may be generally given as:

$$J=AE^2/\phi\exp\,[B\phi^{3/2}/E]$$

In the above relationship it is seen that the current density, J, from the electron emitter is a strong function of the induced electric field, E, which is directly related to an applied extraction voltage.

A technique employed to effect electron emission control of field emission devices (FEDs) is to provide a controllable determined current source to the electron emitter of each field emission device. By determining the available current to each selected field emission device one need not be concerned with fabrication variations as the voltage between the extraction electrode and the electron emitter will assume any required value (within the limits established by attendant voltage sources) to deliver the determined current. However, known methods of realizing determined current source control do not provide for high FED to FED isolation due to the X-Y addressing schemes. Typically, an array of FEDs will be made operable by operably coupling a determined current source to each of a plurality of columns while each row of a plurality of rows of the array of FEDs is selectively energized with a suitable potential. Another shortcoming of prior art techniques is that significant displacement currents are required to charge/discharge an associated line capacitance as each row is selectively, cyclically energized (as may be the case in FED display applications) to a voltage on the order of from 50 to 150 Volts.

Accordingly, there exists a need for a method and field emission device control circuitry which overcomes at least some of these shortcomings.

SUMMARY OF THE INVENTION

This need and others are substantially met through provision of a field emission device and electron emission control circuit comprised of a field emission device which is itself comprised of an electron emitter, for emitting electrons and an extraction electrode proximally, peripherally disposed with respect to the electron emitter; a controlled determined current source comprised of a controlled determined current source semiconductor circuit, such as a current mirror, and having a first input terminal operably connected to a reference potential and a second input terminal for selectively controlling an output electron current level to be provided at an output terminal; and a semiconductor switch comprised of a switching input terminal for receiving switching information, an output terminal operably coupled to the electron emitter, and an electron current input terminal operably coupled to the controlled determined current source output terminal, such that the field emission device is enabled to an ON mode for the time duration of the switching information and during which time the controlled determined current source provides a determined electron current to be subsequently emitted by the electron emitter of the field emission device.

In one preferred embodiment of a field emission device array and electron emission control circuit of the present invention comprised of a plurality of field emission devices, a plurality of semiconductor switches, and a plurality of controlled determined current sources the field emission device electron emitters, semiconductor switches and controlled determined current sources are interconnected to provide for rows of field emission devices to be selectively, and if desired, sequentially placed in an ON mode (enabled to emit electrons) to effect a row by row addressing scheme.

DETAILED DESCRIPTION OF THE DRAWINGS

Figure 1:
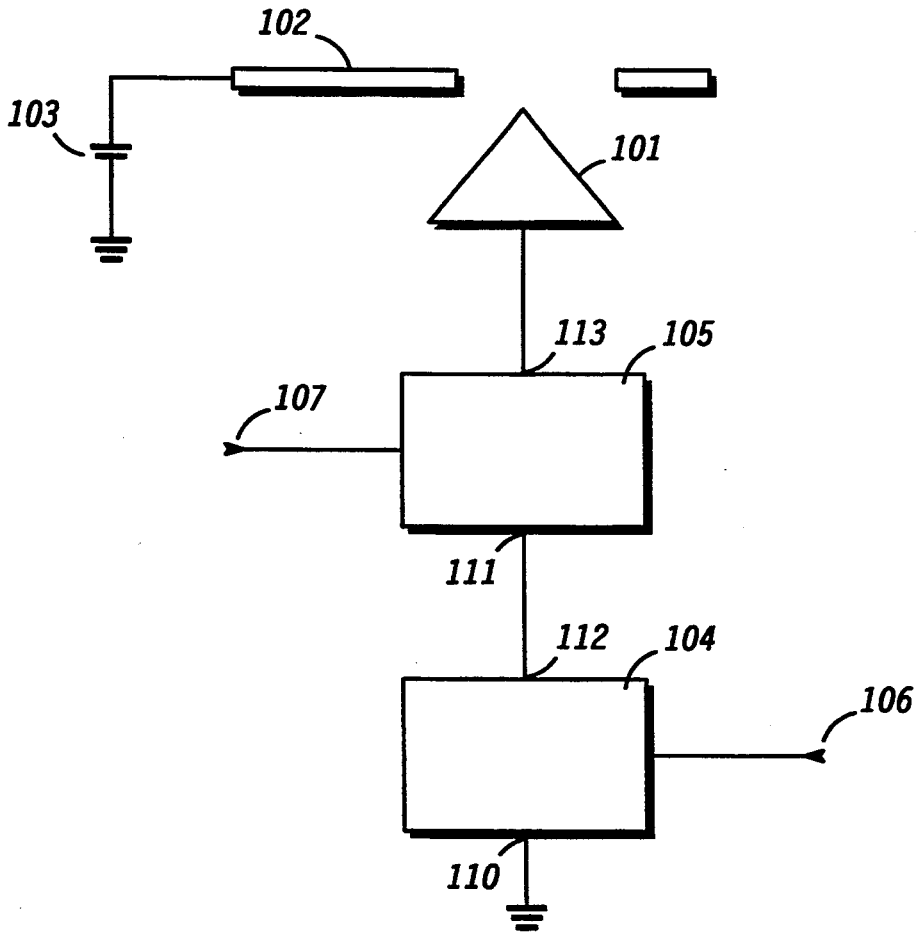
FIG. 1 is a block diagram representation of a field emission device and electron emission control circuit in accordance with the present invention.

FIG. 1 is a block diagram representation of a field emission device and electron emission control circuit in accordance with the present invention. An electron emitter 101 is provided and may be realized by any of many known methods including, but not limited to, selective deposition of conductive/semiconductive materials or selective etching of semiconductor materials. An extraction electrode 102 is provided and, in a physical embodiment, will be proximally disposed, substantially symmetrically, peripherally with respect to electron emitter 101. Electron emission from electron emitter 101 may be effected by providing a suitable potential between electron emitter 101 and extraction electrode 102. FIG. 1 illustrates that this requisite potential may be realized by operably connecting an externally provided voltage source 103 between extraction electrode 102 and a reference potential (herein depicted as ground potential) and by operably connecting a semiconductor switch 105 and a controlled determined current source 104 between electron emitter 101 and the reference potential. Attendant to semiconductor switch 105 is a switching input terminal 107. Attendant to controlled determined current source 104 is a second input terminal 106. A first input terminal 110 being defined as the operable connection to the reference potential. A controlled determined current source output terminal 112 is depicted as operably connected to a semiconductor switch current input terminal 111 to be described subsequently.

Operation of the field emission device and electron emission control circuit is effected by providing an external switching signal onto switching input terminal 107 such that semiconductor switch 105 receives switching information to place the field emission device and electron emission control circuit into an ON mode. When in the ON mode electron emitter 101 of the field emission device emits electrons as provided by controlled determined current source 104. Controlled determined current source 104 provides electrons to be emitted by electron emitter 101 during the time that a suitable externally provided voltage (current path) is operably connected to second input terminal 106. The electron current available to be emitted by electron emitter 101 is substantially the electron current level at output terminal 112, which is controlled by a voltage/current path operably connected to second input terminal 106.

The field emission device and electron emission control circuit of the present invention, as described with reference to FIG. 1 and to be described further subsequently, provides a means for realizing control of device electron emission by utilizing voltage variations on the order of from less than one volt to approximately five volts.

Figure 2:
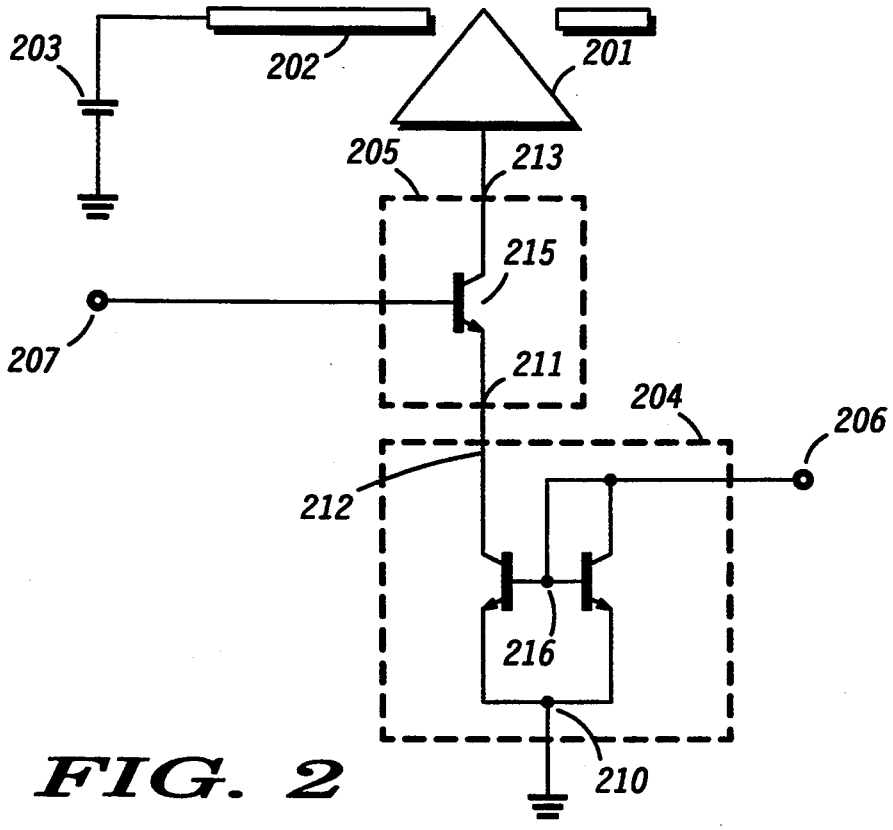
FIG. 2 is a schematic representation of one embodiment of the field emission device and electron emission control circuit of FIG. 1.

FIG. 2 is a schematical representation of the field emission device and electron emission control circuit of the present invention partially described previously with reference to FIG. 1 and wherein features corresponding to those described earlier with reference to FIG. 1 are similarly referenced beginning with the numeral "2". FIG. 2 also depicts that semiconductor switch 205, delineated within a dashed line box, is comprised of a bipolar transistor 215 having switching input terminal 207 operably connected to the base thereof. Output terminal 213 of semiconductor switch 205 is depicted as operably connected to electron emitter 201 and electron current input terminal 211 of semiconductor switch 205 (bipolar transistor emitter) is depicted as operably connected to output terminal 212 of controlled determined current source 204. Output terminal 212 is the output collector of a current mirror bipolar transistor pair 216, delineated within another dashed line box. First input terminal 210 of controlled determined current source 204 is depicted as an interconnection of the emitters of bipolar transistor pair 216 which comprise the current mirror. In the representation of FIG. 2 first input terminal 210 is operably connected to a reference potential which, in this specific embodiment, is ground potential. Second input terminal 206 of controlled determined current source 204 is realized as an interconnection to a diode connected transistor of bipolar transistor pair 216. Operably connecting an externally provided voltage/current path to second input terminal 206 will determine the level (magnitude) and duration of electron current which controlled determined current source 204 provides. Co-incident application of a suitable externally provided switching signal to switching input terminal 207 and a current controlling signal to second input terminal 206 provides a source of electrons to electron emitter 201. It is anticipated that, as is commonly known, the bipolar transistors which comprise bipolar transistor pair 216 of the current mirror may be scaled so as to provide dissimilar collector currents with respect to each other of the pair.

Figure 3:
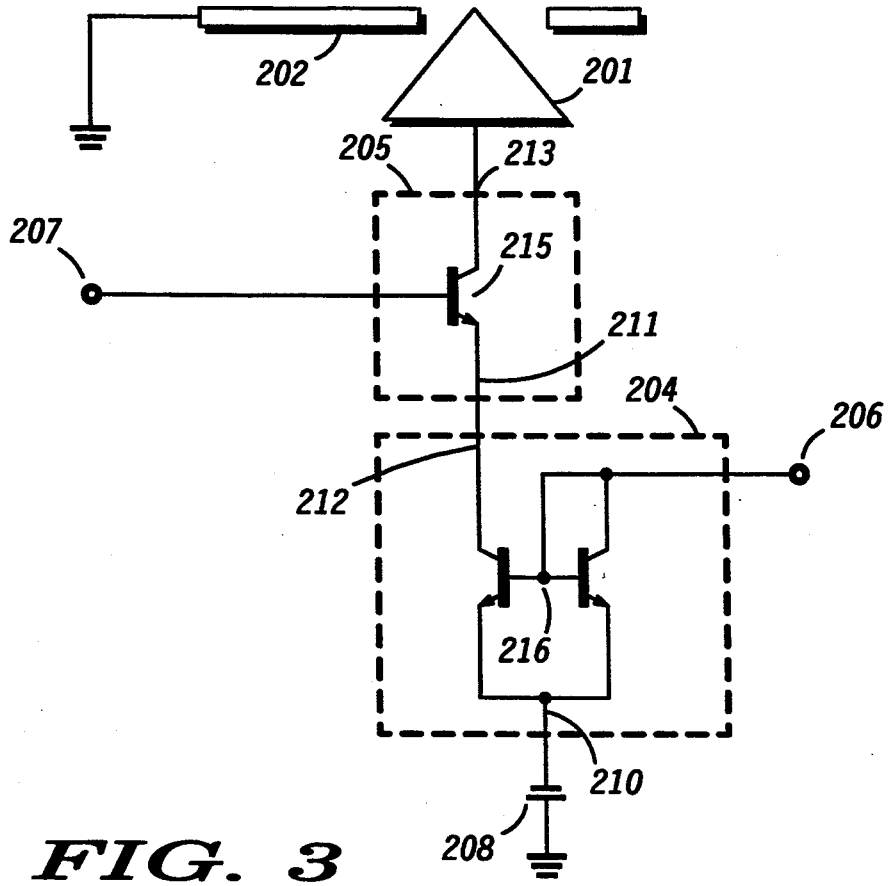
FIG. 3 is a schematic representation of another embodiment of the field emission device and electron emission control circuit of FIG. 1.

FIG. 3 is another embodiment of the field emission device and electron emission control circuit as described previously with reference to FIG. 2 and wherein externally provided voltage source 203, operably connected to extraction electrode 202 in that earlier reference, is herein deleted and extraction electrode 202 is operably connected to ground potential. Further, the potential to which first input terminal 210 is operably connected is realized as a voltage source 208 operably connected between first input 210 and ground potential.

Figure 4:
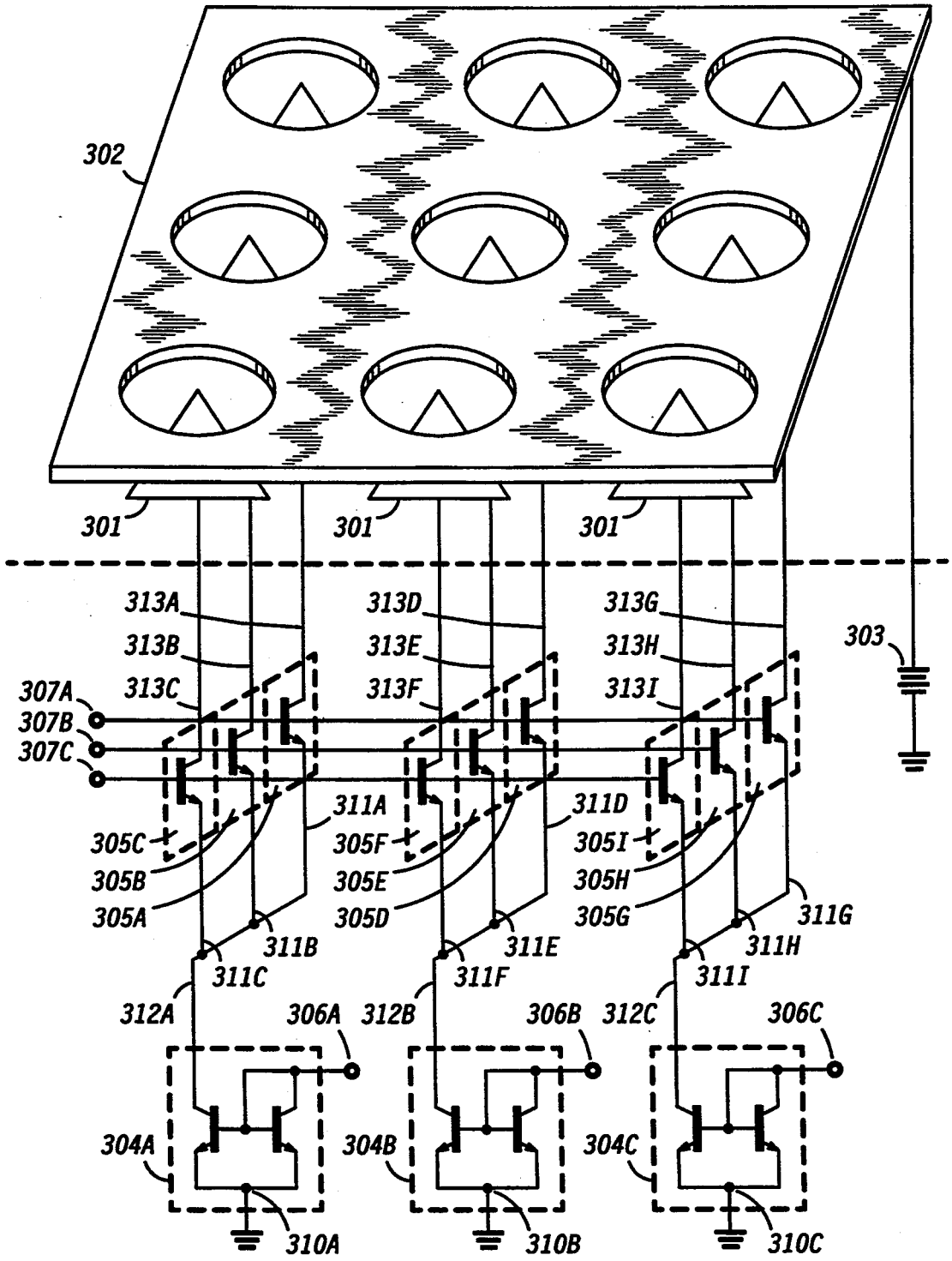
FIG. 4 is a schematic representation of one embodiment of a field emission device array and electron emission control circuit in accordance with the present invention.

FIG. 4 is a schematical representation of an embodiment of a field emission device array and electron emission control circuit comprised of a plurality of field emission devices and a plurality of electron emission control circuits as described previously with reference to FIGS. 1 and 2 and wherein features previously described are similarly referenced beginning with the numeral "3". FIG. 4 further depicts that the plurality of field emission devices are selectively operably interconnected via the associated plurality of electron emission control circuits such that selective application of a switching signal to one of a plurality of switching input terminals 307A, 307B, 307C places one of a plurality of groups of semiconductor switches into an ON mode. For example, by operably connecting a suitable switching signal to switching input terminal 307C a first group of semiconductor switches 305C, 305F, 305I is placed in the ON mode. Co-incident application of a current controlling signal to at least some of the second input terminals 306A, 306B, 306C of a plurality of controlled determined current sources 304A, 304B, 304C determines which of the depicted plurality of field emission devices (field emission device array) corresponding to the selected row emits electrons. Current controlling signals may be independently applied to each second input terminal 306A, 306B, 306C of the plurality of controlled determined current sources 304A, 304B, 304C so that the magnitude and duration of electron emission may be uniquely determined for each field emission device during the dwell time corresponding to the switching signal at a switching input terminal.

By cyclically scanning the switching signal through the plurality of switching inputs 307A, 307B, 307C and providing appropriately timed current control signals to each of second inputs 306A, 306B, 306C of the plurality of electron emission control circuits 304A, 304B, 304C the electron emission from each field emission device of the entire array may be determined.

It should be understood that although an array comprised of three rows and three columns of field emission devices with accompanying electron emission controlling circuitry is depicted in FIG. 4 it is only a convenience and arrays comprised of much greater numbers of field emission devices, even in excess of one million devices, are anticipated. Further, it is a convenience, also, to schematically depict that a single field emission device is controlled by an attendant electron emission control circuit when in practice it is entirely suitable that pluralities of field emission devices may be interconnected to function in concert and effectively in parallel and being controlled by one electron emission control circuit and that arrays of such groups of field emission devices are accordingly anticipated.

Figure 5:
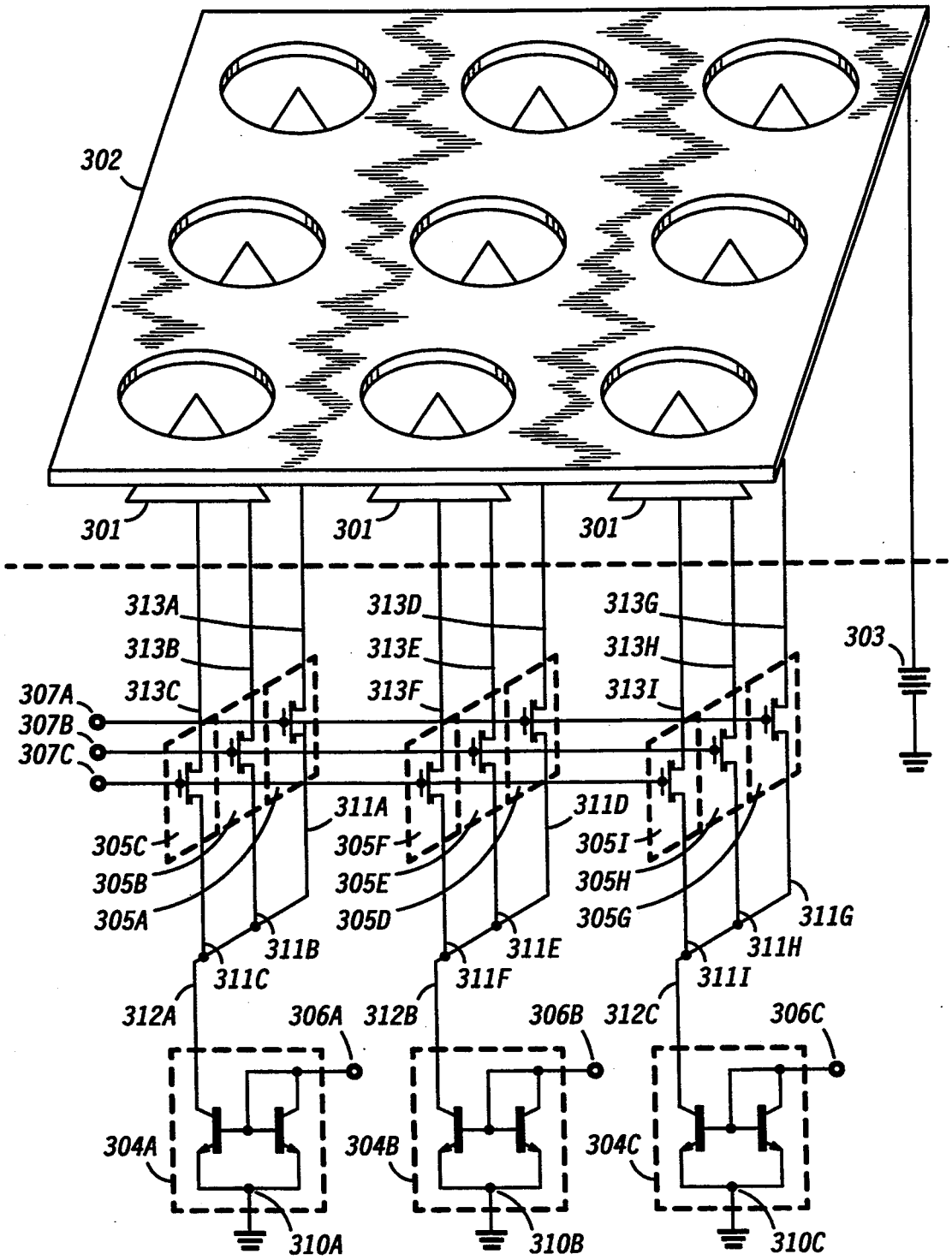
FIG. 5 is a schematic representation of another embodiment of a field emission device array and electron emission control circuit in accordance with the present invention.

FIG. 5 is a schematical representation of another embodiment of a field emission device array and electron emission control circuit as described previously with reference to FIG. 4 and wherein the plurality of semiconductor switches 305A–305I each include a MOS field effect transistor.

Figure 6:
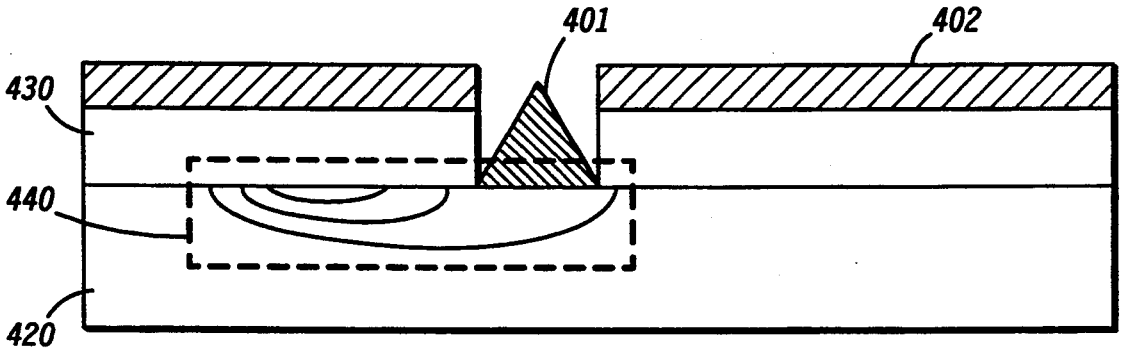
FIG. 6 is a side elevational representation of a part of an integrally formed field emission device and electron emission control circuit in accordance with one embodiment of the present invention.
Figure 7:
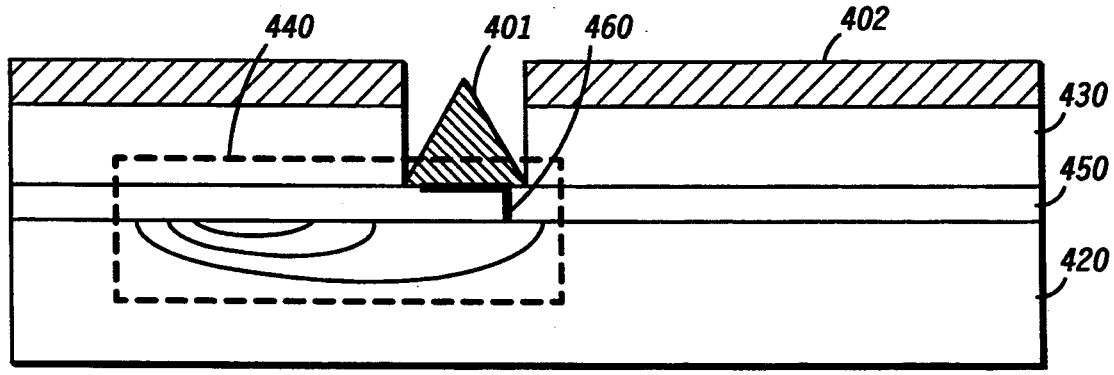
FIG. 7 is a side elevational representation of a part of an integrally formed field emission device and electron emission control circuit in accordance with another embodiment of the present invention.

The electron emission control circuits, herein described, may be advantageously realized in a substrate material by semiconductor device fabrication methods as are known in the art. Such realizations will provide for integral electron emission control as the electron emitter(s) of the FED(s) will be disposed on the substrate or disposed on an insulating layer which layer is disposed on the substrate and operably coupled to the electron emission control circuitry. FIG. 6 is a side elevational depiction of an embodiment of an integrally formed field emission device and electron emission control circuit wherein an electron emission control circuit 440 (delineated within a dashed line box) is realized in a substrate 420 on which an electron emitter 401 is disposed. For the purposes of the device and circuit of the present disclosure electron emitter 401 is operably coupled to electron emission control circuit 440 which is realized in the substrate. Since in side elevational view it is not possible to depict all aspects of the previously schematically described electron emission control circuit, electron emission control circuit 440 is intended in FIG. 6 to serve as a representative depiction of an integrated structure only and it will be immediately understood that a plurality of semiconductor transistor devices may be realized and interconnected in the substrate to realize the electron emission control circuits described previously with reference to FIGS. 1 through 5. FIG. 6 also depicts that an extraction electrode is realized as a layer 402 disposed on an insulator layer 430 which insulator layer 430 is disposed on the substrate 420. FIG. 7 is a variation of the integrated structure described in FIG. 6 wherein a second insulator layer 450 having a conductive path 460 therethrough is disposed on the substrate. Electron emitter 401 is substantially disposed on and operably coupled to conductive path 460 which is also operably coupled to electron emission control circuit 440 disposed in the substrate.

What is claimed is:

1. A field emission device array and electron emission control circuit comprising:

a plurality of field emission devices each of which includes an electron emitter and a common extraction electrode, a part of which common extraction electrode is proximally, peripherally disposed with respect to the electron emitter, the plurality of field emission devices being arranged into rows and columns of an array with each field emission device being positioned in a specific row and column;

a plurality of controlled determined current sources each including a controlled determined current source semiconductor circuit having a first input terminal operably connected to a reference potential and a second input terminal for selectively controlling an output electron current level to be provided at an output terminal, one of the plurality of controlled determined current sources being designated for each column of the array; and a plurality of semiconductor switches each of which includes a switching input terminal for receiving switching information, an output terminal operably coupled to the electron emitter of at least one field emission device, and an electron current input terminal operably coupled to the output terminal of the designated controlled determined current source for the column of the array in which the at least one field emission device is positioned, the switching input terminals of semiconductor switches connected to field emission devices positioned in a row being connected together such that upon receiving switching information some of the plurality of field emission devices positioned in the row of field emission devices are enabled to an ON mode for the time duration of the switching information and during which time the controlled determined current sources of the plurality of controlled determined current sources provide a determined electron current to be subsequently emitted by electron emitters of field emission devices of the enabled row of field emission devices.

2. A field emission device array and electron emission control circuit as claimed in claim 1 having the common extraction electrode operably connected to a voltage potential.

3. A field emission device array and electron emission control circuit as claimed in claim 2 wherein the voltage potential is ground potential.

4. A field emission device array and electron emission control circuit as claimed in claim 2 wherein the voltage potential is provided by an external voltage source operably connected between the extraction electrode and ground potential.

5. A field emission device array and electron emission control circuit as claimed in claim 4 wherein the reference potential is ground potential.

6. A field emission device array and electron emission control circuit as claimed in claim 1 wherein the reference potential is provided by an external voltage source operably connected between the first input terminal and ground potential.

7. A field emission device and integrally electron emission control circuit comprising:

a field emission device including an electron emitter, for emitting electrons, and an extraction electrode proximally, peripherally disposed with respect to the electron emitter;

a controlled determined current source including a controlled determined current source semiconductor circuit realized in a substrate on which the electron emitter is disposed and having a first input terminal operably connected to a reference potential and a second input terminal for selectively controlling an output electron current level to be provided at an output terminal; and a semiconductor switch realized in the substrate and including a switching input terminal for receiving switching information, an output terminal operably coupled to the electron emitter, and an electron current input terminal operably coupled to the controlled determined current source output terminal, such that upon application of switching information to the semiconductor switch the field emission device is enabled to an ON mode for the time duration of the switching information and during which time the controlled determined current source provides a determined electron current to be subsequently emitted by the electron emitter of the field emission device.

8. A field emission device and electron emission control circuit as claimed in claim 7 wherein the reference potential is provided by an external voltage source operably connected between the first input and ground potential.

9. A field emission device and electron emission control circuit as claimed in claim 7 wherein the controlled determined current source semiconductor circuit includes a current mirror.

10. A field emission device array and integrally formed electron emission control circuit comprising:

a plurality of field emission devices each of which includes an electron emitter and a common extraction electrode, a part of the common extraction electrode being proximally, peripherally disposed with respect to the electron emitter;

a plurality of controlled determined current sources each including a controlled determined current source semiconductor circuit realized in a substrate on which the electron emitter is disposed and having a first input terminal operably connected to a reference potential and a second input terminal for selectively controlling an output electron current level to be provided at an output terminal; and a plurality of semiconductor switches realized in the substrate each including a switching input terminal for receiving switching information an output terminal operably coupled to at least one electron emitter, and an electron current input terminal operably coupled to a controlled determined current source output terminal of the plurality of controlled determined current sources, such that upon receiving switching information some of the plurality of field emission devices which substantially comprise a row of field emission devices is enabled to an ON mode for the time duration of the switching information and during which time the controlled determined current sources of the plurality of controlled determined current sources provides a determined electron current to be subsequently emitted by each electron emitter of each field emission device of the enabled row of field emission devices.

11. A field emission device array and electron emission control circuit as claimed in claim 10 having the common extraction electrode operably connected to a voltage potential.

12. A field emission device array and electron emission control circuit as claimed in claim 11 wherein the voltage potential is ground potential.

13. A field emission device array and electron emission control circuit as claimed in claim 11 wherein the voltage potential is provided by an external voltage source operably connected between the extraction electrode and ground potential.

14. A field emission device array and electron emission control circuit as claimed in claim 10 wherein the reference potential is ground potential.

15. A field emission device array and electron emission control circuit as claimed in claim 10 wherein the reference potential is provided by an external voltage source operably connected between the first input terminal and ground potential.

* * * * *